US006628421B1

(12) United States Patent
Cerutti

(10) Patent No.: US 6,628,421 B1
(45) Date of Patent: Sep. 30, 2003

(54) ELECTRONIC DEVICE FOR THE CONTROL OF MOVING ELEMENTS IN TEXT AND/OR IMAGE PROCESSING EQUIPMENT

(75) Inventor: Walter Cerutti, Ivrea (IT)

(73) Assignee: Olivetti Tednost S.p.A., Ivrea (IT)

( * ) Notice: Subject to any disclaimer, the term of this patent is extended or adjusted under 35 U.S.C. 154(b) by 0 days.

(21) Appl. No.: 09/743,264

(22) PCT Filed: Jul. 2, 1999

(86) PCT No.: PCT/IT99/00203

§ 371 (c)(1),
(2), (4) Date: Jan. 8, 2001

(87) PCT Pub. No.: WO00/01532

PCT Pub. Date: Jan. 13, 2000

(30) Foreign Application Priority Data

Jul. 6, 1998 (IT) ..... T098A0593

(51) Int. Cl.[7] ..... G06R 15/00
(52) U.S. Cl. ..... 358/1.5; 358/1.9
(58) Field of Search ..... 348/135, 14.15; 358/1.5, 1.9, 502, 311, 312

(56) References Cited

U.S. PATENT DOCUMENTS

| | | | | | |
|---|---|---|---|---|---|
| 4,652,159 A | | 3/1987 | Nagai | 400/322 |
| 5,620,266 A | | 4/1997 | Kim | 400/279 |
| 5,621,668 A | * | 4/1997 | Nakata | 364/569 |
| 6,112,750 A | * | 9/2000 | Chandra | 128/898 |
| 6,390,097 B1 | * | 5/2002 | Chandra | 128/898 |
| 2002/0047903 A1 | * | 4/2002 | Shibuya | 348/190 |

FOREIGN PATENT DOCUMENTS

| | | | | |
|---|---|---|---|---|
| EP | 329371 | | 8/1989 | B41J/19/20 |
| EP | 664221 | | 7/1995 | B41J/19/18 |
| GB | 2183873 | * | 10/1987 | G06K/15/00 |
| JP | 363166369 A | * | 7/1988 | H04N/5/14 |

* cited by examiner

*Primary Examiner*—Jerome Grant, II
(74) *Attorney, Agent, or Firm*—Banner & Witcoff, Ltd.

(57) ABSTRACT

This invention relates to a device for controlling the activation of moving elements, such as for example an ink jet type print-head or a sensor of equipment for scanning text and/or images. The device, upon the measurement by means of, for example, the moving element to travel the step P, and the basis of selectively predefined numerical values associated through the control circuit with the time T(p), permits division of the step (p) into a number of n of elementary steps P/n uniformly distributed through the step P, including for high values of the number n. Accordingly by means of the device it is possible to obtain considerable uniform printing or scanning under all conditions and, in particular, when the resolution, which depends on the value of the number n, has to be at its maximum.

9 Claims, 2 Drawing Sheets

ELECTRONIC DEVICE FOR THE CONTROL OF MOVING ELEMENTS IN TEXT AND/OR IMAGE PROCESSING EQUIPMENT

TECHNICAL FIELD

This invention relates to an electronic device for the control of moving elements in text and/or image processing equipment comprising detecting means suitable for detecting intervals of space P corresponding to displacements of the moving element, timing means associated with the detecting means and suitable for linking an initial time and a determined time interval $T_P$ with each of the intervals of space P, and exciting means associated with the moving element for exciting the moving element at n instants of time inside the time interval $T_P$.

More particularly, the invention relates to an electronic device for controlling the positioning and activation of a print-head of a dot matrix printer, of the ink jet type for example, or of a sensor in equipment for the scanning of text and/or images.

BACKGROUND ART

Dot printing, for example printing with ink jet printers, is effected by making a print-head translate transversally to a medium, generally paper, and selectively exciting a plurality of nozzles, placed orthogonally to the direction of movement of the head, for printing on the paper medium or the sheet through the emission of ink. The times at which to excite the nozzles of the head are calculated by taking as the reference in cyclical fashion an interval of space or step P which, in cases where the head is moved by a step motor, corresponds to one step of the motor and, where the head is controlled by an optical or magnetic encoder, corresponds to the minimum interval detected by the encoder.

To effect printing, see for example the European Patent Publication EP-A-0 664 221, each step P is divided into a plurality of elementary steps P/n and the excitation of the nozzles of the head is effected upon the completion of each elementary step P/n.

The elementary step P/n is calculated by taking as the reference the interval $T_P$, corresponding to the time taken by the print-head to travel the step P, and dividing the interval $T_P$ by the number n.

In the known art, the excitation of the nozzles is performed at the time $T_P/n$ and subsequently at each successive elementary step P/n by repeatedly adding $T_P/n$ until the reference period $T_P$ is reached.

The number n of excitations of the print-head in the step P is strictly related to the printing resolution which is calculated in "points per inch" (ppi) and corresponds to the number of excitations of the print-head per unit length of one inch or, in metric terms, 25.4 mm; the step P is in actual fact a sub-multiple of the unit length and the division of the step P into elementary steps P/n therefore gives the printing resolution.

Naturally the printing resolution in some printers can be selected from a range of discrete values between a minimum and a maximum printing resolution, for example 600 ppi or 1200 ppi.

A first problem in the known art comes from the method of calculating the value $T_P/n$ corresponding to the elementary step P/n.

In actual fact, as the division of the value $T_P$ by the number n generally gives a value having an integral part $t_i$ and a decimal part $t_r$ corresponding to the remainder, the result is that, it being impossible in a binary system such as an electronic printer to take into account the time $t_r$, the latter is neglected and only the value $t_i$ which corresponds to the integral part of $T_P/n$ is used to excite the print nozzles.

By neglecting the time $t_r$, by adding instant by instant the value $t_i$ and by exciting the print nozzles in correspondence with the instants of time thus calculated, it occurs that the error due to $t_r$ continues to rise until a maximum of n times $t_r$, a value which in some cases may even correspond to a few elementary printing steps P/n. From the practical viewpoint, and assuming that $t_i$ is approximated up or down to the theoretical value $T_P/n$, dot printing is of varying intensity in correspondence with the extremities of each step P.

A further technical problem, linked to the previous one, consists of the fact that, as n and accordingly the corresponding printing resolution increase, the error due to $t_r$ also increases, with the result that the uniformity of printing, and therefore the printing quality, worsens, exactly under the conditions where it should be maximal when the printing resolution is maximal.

DISCLOSURE OF THE INVENTION

The object of this invention is to resolve the range of technical problems described above and which may be resumed as a lack of uniformity observed in particular in dot matrix printers, but which is also present in scanning equipment and, in general, in text and/or image processing equipment using a movable element to be positioned and activated with precision in an interval of space P.

This technical problem is solved by the electronic device for the control of moving elements in text and/or image processing equipment characterised by control means associated with the timing means and with the exciting means both for selectively adding to the initial time a plurality of numerical values each corresponding to each of the n instants and for controlling the exciting means by way of the plurality of numerical values.

In accordance with a further characteristic of this invention, a method is also described for the control of moving elements in text and/or image processing equipment characterised by the technique of associating with the initial time and the time interval $T_P$, a plurality of numerical values predefined in relation with the number of the n instants such that the combination of the time interval $T_P$ with the plurality of numerical values guarantees that each of the n instants inside the time interval $T_P$ is calculated by adding absolute values to the initial time and not by incrementally adding n-times the integral part of $T_P/n$.

BRIEF DESCRIPTION OF THE DRAWINGS

This and other characteristics of the present invention will become apparent from the following description of a preferred embodiment, provided by way of a non-limiting example and with reference to the accompanying drawings, wherein.

BEST MODE FOR CARRYING OUT THE INVENTION

Figure 1:
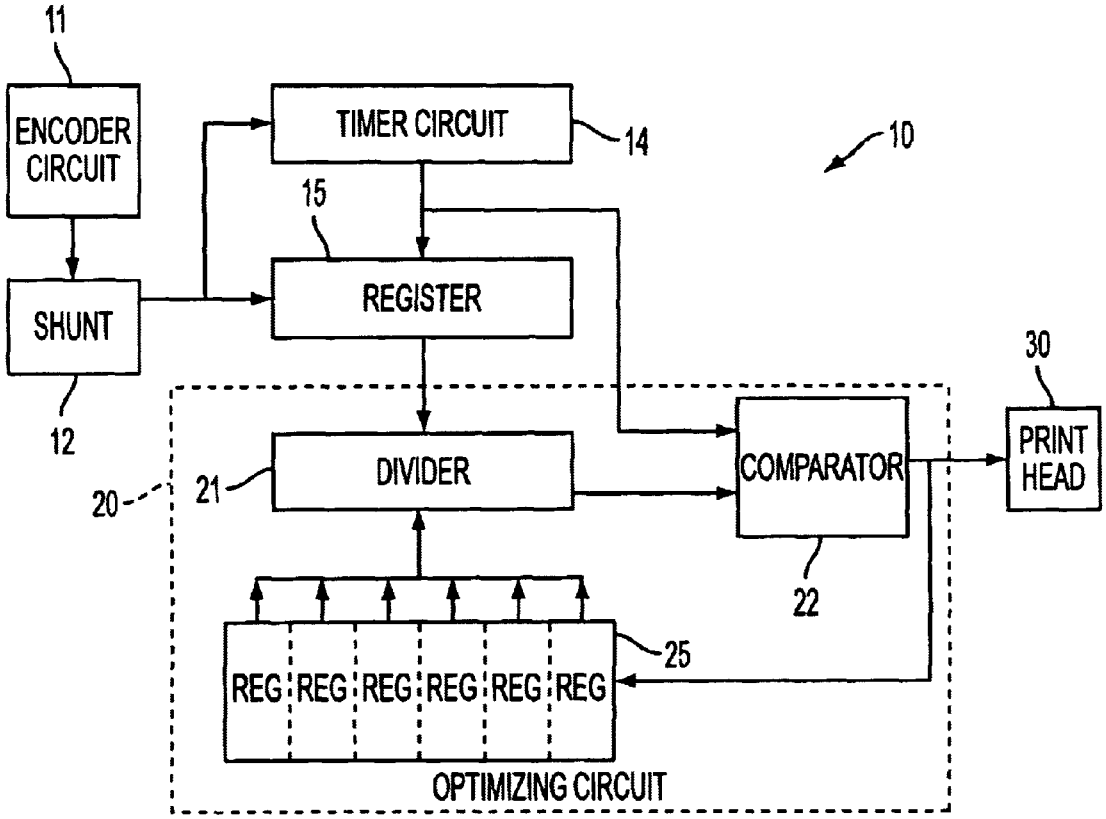
FIG. 1 represents a general block diagram of the device according to the invention.
Figure 2:
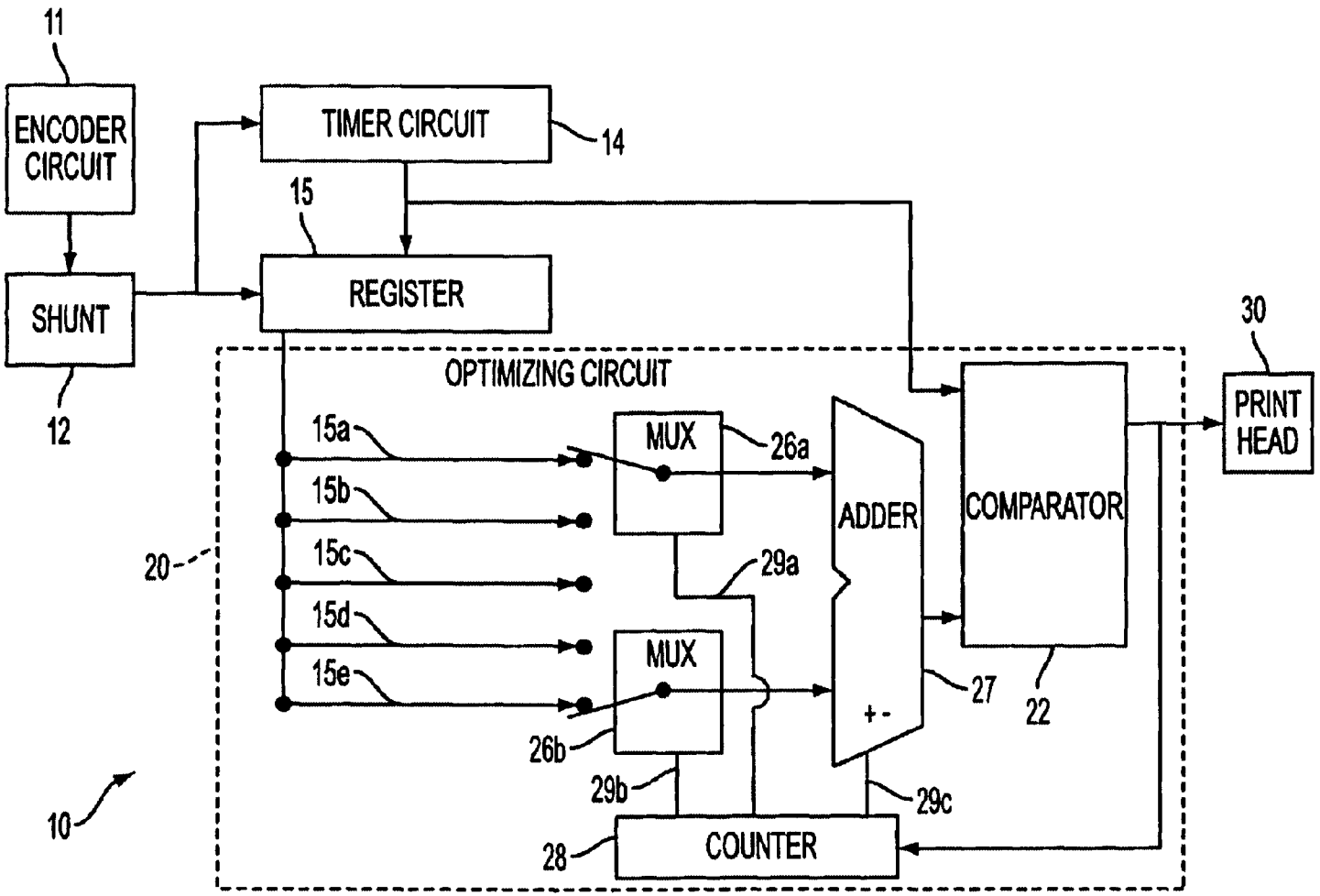
FIG. 2 represents one embodiment of the device of FIG. 1.

With reference to FIG. 1 the electronic device for the control of moving elements in text and/or image processing equipment (device) 10 comprises an encoder circuit 11, of known type, suitable for detecting, by means of a sensor of, for example, the optical or magnetic type, unitary distances or steps P travelled by a movable element, for example a print-head or movable head 30, and for outputting predefined electrical signal levels in correspondence with the beginning and end of each step P.

The device 10 also comprises a shunt circuit (shunt) 12 and a timer circuit 14, of known type, cascade connected to the encoder 11 and respectively suitable, the shunt 12 for outputting a pulse in correspondence with the changes of level of the electrical signal coming from the encoder 11, has to be activated uniformly in predefined intervals of space P.

What is claimed is:

1. Electronic device for the control of a moving element in text and/or image processing equipment comprising detecting means suitable for detecting intervals of space P corresponding to displacements of said moving element;

timing means associated with said detecting means suitable for linking an initial time and a determined time interval $T_P$ with each of said intervals of space P;

exciting means associated with said moving element for exciting said moving element at n instants of time inside the time interval $T_P$; characterised by control means associated with said timing means and with said exciting means both for selectively adding to said initial time a plurality of numerical values each corresponding to each of said n instants and for controlling said exciting means by way of said plurality of numerical values in order to activate said moving element in said interval of space P at n different instants.

2. Device according to claim 1 characterised in that said control means comprises storing means suitable for storing said plurality of numerical values.

3. Device according to claim 1 characterised in that said control means comprises calculating means suitable for calculating each of said n instants of time in relation to said to said determined time $T_P$ and to said plurality of numerical values.

4. Device according to claim 1 characterised in that said control means comprises selection means suitable for selecting a plurality of time splits of said time interval $T_P$ in relation to said plurality of numerical values.

5. Device according to claim 4 characterised in that said plurality of time splits correspond to splits to the power of 2 of the time interval $T_P$.

6. Device according to claim 4 characterised in that said control means further comprises an adder circuit suitable for selectively adding at least a couple of said time splits for controlling said exciting means.

7. Method for the control of a moving element in text and/or image processing equipment comprising the steps of detecting intervals of space P corresponding to displacements of said moving element;

associating with an interval of space P a corresponding initial time, a time interval $T_P$ and n instants of time inside the time interval $T_P$ in which to activate predefined functions of said moving element; characterised by the steps of selectively associating with said time interval $T_P$ a plurality of numerical values predefined in relation with the number of said n instants; and calculating in relation to said initial time, to said time interval $T_P$ and to said plurality of numerical values each of said n instants inside the time interval $T_P$.

8. Method according to claim 7 characterised in that the step of calculating a predefined number n of instants comprises the steps of storing said time interval $T_P$;

selecting from said time interval $T_P$ a plurality of time splits of said time interval $T_P$ in relation to said plurality of numerical values.

9. Method according to claim 8 characterised by the further step of selectively adding at least a couple of said time splits of said determined time $T_P$ for controlling the activation of predefined functions of said moving element.

* * * * *

UNITED STATES PATENT AND TRADEMARK OFFICE

CERTIFICATE OF CORRECTION

PATENT NO. : 6,628,421 B1
DATED : September 30, 2003
INVENTOR(S) : Walter Cerutti It is certified that error appears in the above-identified patent and that said Letters Patent is hereby corrected as shown below:

Title page,
Item [73], Assignee, "Tednost" has been replaced with -- Tecnost --;
Item [30], Foreign Application Priority Data, "TO98A0593" has been replaced with -- TO98A000593 --;
Item [57], ABSTRACT,
Line 1, -- (10) -- has been inserted after "device";
Line 2, -- (30) -- has been inserted after "moving elements";
Line 4, -- (10) -- has been inserted after "The device";
Line 5, -- an encoding circuit (11) and a timing circuit (14) of respectively the step P and the time period $T_P$, corresponding to the time taken by -- has been inserted before "the moving element";
Line 5, -- (30) -- has been inserted after "the moving element";
Line 6, -- on -- has been inserted before "the basis of";
Line 7, -- (20) -- has been inserted after "the control circuit";
Line 8, "(p)" has been replaced with -- P --;
Line 10, -- (10) -- has been inserted before "the device";
Line 10, "considerable" has been replaced with -- considerably --.

Signed and Sealed this

Tenth Day of February, 2004

JON W. DUDAS
*Acting Director of the United States Patent and Trademark Office*